United States Patent [19]

Kakiuchi

[11] 4,330,975

[45] May 25, 1982

[54] SIMPLIFIED VACUUM-PACKAGE SEALER APPARATUS

[76] Inventor: Kunio Kakiuchi, 19-117 12, Yamashiro-Onsen, Kagashi, Ishikawa-ken, Japan

[21] Appl. No.: 175,662

[22] Filed: Aug. 5, 1980

[51] Int. Cl.[3] ..... B65B 31/06

[52] U.S. Cl. ..... 53/79; 53/512

[58] Field of Search ..... 53/512, 373, 390, 434, 53/88, 79

[56] References Cited

U.S. PATENT DOCUMENTS

| | | | |
|---|---|---|---|
| 2,838,894 | 6/1958 | Paikens et al. | 53/512 X |
| 2,963,838 | 12/1960 | Harrison et al. | 53/512 X |
| 3,376,690 | 4/1968 | Jianas | 53/512 |
| 3,516,223 | 6/1970 | Anderson et al. | 53/512 |

*Primary Examiner*—Horace M. Culver
*Attorney, Agent, or Firm*—George B. Oujevolk

[57] ABSTRACT

A vacuum package sealer apparatus comprising an operation lever thereon carrying a heat plate for sealing an opening portion of a yieldable bag, a retention lever thereon carrying an elastomeric member for retaining the bag opening portion in a closed state, a conduit member having an opening at the distal end and a soft, porous cap member mounted on said distal end opening for evacuating the interior of said bag, a base plate having platen plate means and a pivot shaft positioned thereon, said operation lever, said retention lever and said conduit member being mounted around said pivot shaft for turning movement thereabout, said elastomeric member being in closer proximity to said pivot shaft than said heat plate, said distal end of said conduit member being positioned between said elastomeric member and said heat plate, a spring being interposed between said operation lever and said retention lever, whereby a first exertion of turning force to said operation lever causes said conduit member to be held initially between said elastomeric member and said platen plate means and a further exertion of turning force thereto causes the heat plate to become in contact with said platen plate means.

1 Claim, 4 Drawing Figures

SIMPLIFIED VACUUM-PACKAGE SEALER APPARATUS

BACKGROUND OF THE INVENTION

This invention relates to a vacuum package sealer apparatus capable of rendering the interior of a package bag of a yieldable material such as polyethylene (hereinafter called "yieldable package bag") vacuum and fuse-sealing the opening of the yieldable bag by application of heat.

DESCRIPTION OF THE PRIOR ART

Vacuum package sealer apparatuses have been known which operate to render the interior of a yieldable package bag vacuum with a blood product or the like therein and then to fuse-seal the operation of the bag by application of heat. Any conventional apparatuses of this class are spaceous and have intricate mechanisms for the purposes of high quality and accordingly are too expensive to economically be accepted by homes or grocery stores where one would like to make use of such sealer apparatuses for vacuum packaging.

OBJECT OF THE INVENTION

One of the objects of the invention is to provide an inexpensive compact sealer apparatus for vacuum packaging having a miniaturized mechanism capable of operating in a simplified manner.

DETAILED DESCRIPTION OF PREFERRED EMBODIMENT

Figure 1:
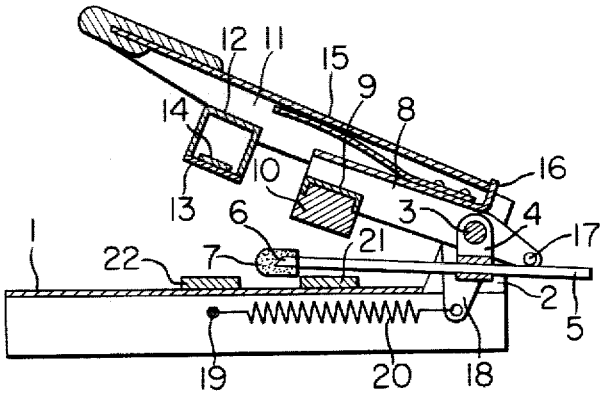
FIG. 1 is a side view showing one embodiment of the invention, with part depicted in section.
Figure 2:
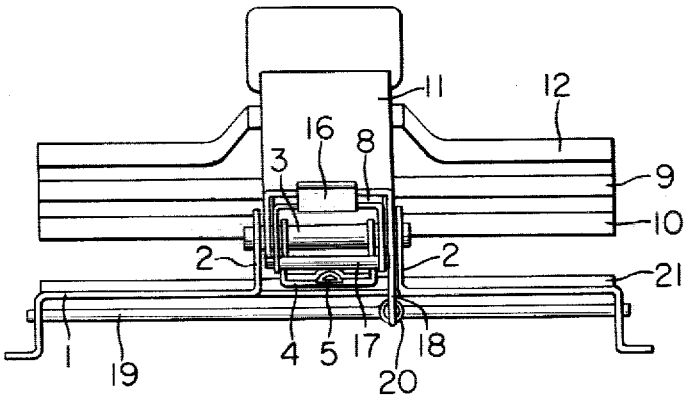
FIG. 2 is a rearside view of the embodiment of FIG. 1.

A sealer apparatus for vacuum packaging according to the invention includes a base plate 1 having a determined area of the upperside surface and having a pair of bracket 2,2 spaced in opposition by a determined distance to each other in the rear end thereof. They are formed one-piece by raising corresponding portions of the base plate. The brackets 2,2 bear a pivot shaft 3 to which a conduit holder member 4 is secured. The member 4 holds in the center a conduit member 5 which extends normally across the member 4 and terminates as a conduit opening 6 positioned above the upperside surface of the base plate. A soft, porous cap member 7 is secured to and closes the end opening 6.

Turnably about the pivot shaft 3 mounted is a retention lever 8 having a determined width and a corresponding length to the distance from the shaft 3 to the cap member 7. The retention lever has a holder 9 secured on the underside adjacent the free end. The holder 9 is elongate transversely of the base plate and has an elastomeric plate 10 on the underside surface. Further, an operation lever 11 is also mounted rotatably about the pivot shaft 3 and positioned above the retention lever 8. The operation lever 11 has a greater length than the retention lever 8 and thus extends at a substantial distance forwardly beyond the the free end of the retention lever 8. The operation lever 11 has a transversely elongate heat plate holder 12 secured on the underside surface and positioned forward from the position of the cap member 7. The holder 12 has a heat plate 13 on the upperside surface and the heat plate 13 has a heat generating member 14 on the upperside surface. A spring 15 is interposed between the retention lever 8 and the operation lever 11. A stopper member 16 is provided at the rear end of the retention lever 8 and can be engaged and turned together with the retention lever 8 when the operation lever 11 is opened to a greater degree of angle than a determined degree relative to the retention lever 8. The retention lever 8 is provided with a stopper 17 projecting from the pivot shaft 3 in the opposite direction to the retention lever and acts to limit the retention lever 8 from moving to any further degree of angle relative to the base plate 1. The operation lever 11 is provided integrally with a bracket 18 projecting from the pivot shaft in the opposite side to the operation lever and in the lower direction. A tension spring 20 is disposed between the bracket 18 and a pin 19 planted in the forward portion of the base plate 1. The base plate 1 is provided on the upperside surface with platen plates 21 and 22 which are positioned in rotationally corresponding positions of the elastomeric plate 10 of the retention plate 8 and the heat plate 13 of the operation lever 11.

Figure 3:
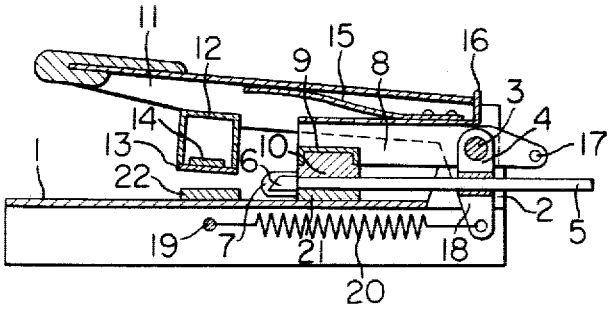
FIG. 3 is a similar view to FIG. 1, but showing the action of air evacuation.
Figure 4:
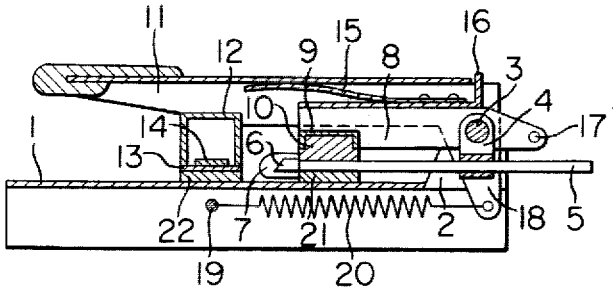
FIG. 4 is also a similar view to FIG. 1, but again showing the sealing action.

Operation of the above stated embodiment of the invention will be described. FIG. 1 shows the state of the apparatus where the operation lever 11 is not as yet operated. The operation lever 11 in that state is slantingly postured by action of the tension spring 20 and the retention lever 8 is also similarly postured with the stopper member 16 being engaged by the operation lever 11. The retention lever 8 has the stopper 17 urging the conduit member 5 slightly into an angular position that the conduit member proper is slightly raised above the base plate upperside surface. When the components are located in these positions, an opening of a yieldable package bag is fitted on the end opening portion 6 of the conduit member so that the bag opening portion is located on the platen plate 21, and when the operation lever is manually lowered against the force of the tension spring 20, the retention lever 8 is thereby turned, keeping a spacing from the operation lever 11 by the interposition of the spring 15. This brings the components to the positions as shown in FIG. 3 where the end opening 6 of the conduit member and the bag opening fitted thereon are engaged between the elastomeric plate 10 and the platen plate 21, closing the bag opening. In this condition, air in the bag is discharged through the conduit member 5 by means of evacuation means not shown, or, for instance, a vacuum pump, or when the sealer apparatus is used in homes, a vacuum cleaner may be conveniently connected through an adaptor as evacuation means. When the interior of the bag is evacuated, depression force may be added to the operation lever 11 to further turn the operation lever against tensional force of the spring 15, independently from the retention lever 8, until the heat plate 13, as shown in FIG. 4, becomes in contact with the platen plate 22 with the opening portion of the bag held therebetween to seal the bag opening by action of heat from the heat plate 13.

It is obvious that the retention lever 8 or the operation lever 11 may be related to the power switch of the evacuation means so that the elastomeric plate 10 becomes in contact with the platen plate 21, the power switch turns on to actuate the evacuation means and when the elastomeric plate 10 becomes out of contact with platen plate 21, the same switch turns off to deactuate the evacuation means. It is desired that the operation lever 11 be constructed in a sliding or folding arrangement permitting adjustment of the length thereof.

It is to be understood from the foregoing description of the embodiment of the invention that the latter can provide a vacuum package sealer apparatus having a much simplified structure which can be compactly, inexpensively assembled and which permits a simple two-step depression manipulation of the operation lever to achieve retention of the bag opening portion to be sealed, evacuation of the bag interior and fuse-sealing of the bag opening. Thus, the apparatus according to the invention facilitates general homes, grocery stores and the like processing food products by vacuum packaging for preserving them against decay and modification.

What is claimed is:

1. A vacuum package sealer apparatus comprising an operation lever thereon carrying a heat plate for sealing an opening portion of a yieldable bag, a retention lever thereon carrying an elastomeric member for retaining the bag opening portion in a closed state, a conduit member having an opening at the distal end and a soft, porous cap member mounted on said distal end opening for evacuating the interior of said bag, a base plate having platen plate means and a pivot shaft positioned thereon, said operation lever, said retention lever and said conduit member being mounted around said pivot shaft for turning movement thereabout, said elastomeric member being in closer proximity to said pivot shaft than said heat plate, said distal end of said conduit member being positioned between said elastomeric member and said heat plate, a spring being interposed between said operation lever and said retention lever, whereby a first exertion of turning force to said operation lever causes said conduit member to be held initially between said elastomeric member and said platen plate means and a further exertion of turning force thereto causes the heat plate to become in contact with said platen plate means.

* * * * *